United States Patent [19]

Rasen et al.

[11] 4,181,450

[45] Jan. 1, 1980

[54] EROSION CONTROL MATTING

[75] Inventors: Alfred Rasen; Rolf Vollbrecht; Klemens Schenesse, all of Obernburg, Fed. Rep. of Germany

[73] Assignee: Akzona Incorporated, Asheville, N.C.

[21] Appl. No.: 784,361

[22] Filed: Apr. 4, 1977

Related U.S. Application Data

[63] Continuation-in-part of Ser. No. 703,277, Jul. 7, 1976.

[30] Foreign Application Priority Data

Apr. 2, 1976 [DE] Fed. Rep. of Germany ... 7610269[U]

[51] Int. Cl.[2] ..... E02D 31/06

[52] U.S. Cl. ..... 405/19; 428/139; 428/284; 428/285; 428/288; 428/296

[58] Field of Search ..... 61/35, 37, 38, 7; 428/92, 156, 171, 72, 73, 172, 317, 320, 321, 286, 287, 288, 296, 178, 182, 195, 183, 198, 138, 139, 284, 297, 298, 302, 303, 304, 306, 308; 156/167, 244, 62.4, 62.8, 62.2, 181, 168, 176, 178, 179, 423; 264/DIG. 75, 210 F, 176 F; 405/16, 19, 50

[56] References Cited

U.S. PATENT DOCUMENTS

| | | | |
|---|---|---|---|
| 3,266,969 | 8/1966 | Makansi | 428/92 |
| 3,565,729 | 2/1971 | Hartmann | 156/167 |
| 3,654,063 | 4/1972 | Blackburn et al. | 428/182 |
| 3,670,504 | 6/1972 | Hayes et al. | 61/37 |
| 3,676,239 | 7/1972 | Soehngen | 156/209 |
| 3,687,759 | 8/1972 | Werner et al. | 156/167 |
| 3,691,004 | 9/1972 | Werner et al. | 428/296 |
| 3,775,210 | 11/1973 | Paquette et al. | 156/178 |
| 3,802,980 | 4/1974 | Harmon | 156/178 |
| 3,837,988 | 9/1974 | Hennen et al. | 156/167 |
| 3,914,501 | 10/1975 | Miller et al. | 428/296 |
| 3,928,696 | 12/1975 | Wandel et al. | 405/19 |
| 3,934,421 | 1/1976 | Daimler et al. | 405/16 |
| 4,055,268 | 8/1977 | Barthel | 428/296 |
| 4,076,879 | 2/1978 | Suskind et al. | 428/317 |

FOREIGN PATENT DOCUMENTS

| | | | |
|---|---|---|---|
| 1276161 | 10/1961 | France | 428/317 |
| 921132 | 3/1963 | United Kingdom | 428/317 |

*Primary Examiner*—Stanley S. Silverman
*Attorney, Agent, or Firm*—John H. Shurtleff

[57] ABSTRACT

A porous, reinforced, erosion control matting is provided by a relatively open, self-supporting, three-dimensionally looped structure of synthetic filaments having a diameter of at least 0.06 mm., with a backing of a decay-resistant or rot-resistant, comparatively dense web or fabric which is bonded to at least some of the filaments of the matting, and with a lattice or open-mesh reinforcing facing member extending parallel to the backing to provide an upper surface of crossbars onto which the looped synthetic filaments are laid so as to be interlocked with the crossbars while extending downwardly between the crossbars to form porous alveolate cells. The matting is highly useful in preventing soil erosion while also being easily manufactured and installed in any given location.

29 Claims, 5 Drawing Figures

EROSION CONTROL MATTING

This application is a continuation-in-part of our earlier copending application Ser. No. 703,277, filed July 7, 1976, the disclosure of which is incorporated herein by reference as fully as if set forth in its entirety.

More particularly, the present invention is a further development of the embodiments disclosed in original FIGS. 7, 7*a*, 8 and 9 of this copending application which disclose a grid or lattice support to receive freshly spun filaments in a random looping pattern. The specific procedures followed in this earlier copending application can be largely adopted for purposes of the present invention when using an open-mesh screen, grid, lattice or the like but with the further addition of a backing member spaced below and parallel to the lattice to provide a base for soil retention while still remaining permeable to water. Moreover, the matting of the present invention is achieved by intentionally draping or laying the synthetic filaments over the crossbars of the lattice so as to become interlocked or attached thereto, the lattice then being permanently incorporated as a reinforcing structure.

Erosion control matting is used to reinforce dikes, shorelines, beaches, dams, embankments, stream beds and canals to prevent washing or erosion of sand, soil, turf, etc. It has long been known to use an erosion control matting consisting of tangled nonwovens made of bonded synthetic fibers or filaments. At first, the nonwoven sheets were secured mechanically to the ground layer undergoing erosion by means of wooden stakes or steel pins. However, it soon became apparent that the points at which the stakes or pins had been driven through the nonwoven, e.g. in hydraulics projects, were starting points for renewed erosion damage, especially an underscouring or undercutting of the control matting. Consequently, it became desirable to avoid nonwoven sheets secured mechanically to the ground. Instead, these nonwoven sheets after being laid out were weighted with sand, gravel, slag, etc. This led to the necessity of manufacturing nonwovens with a space between fibers or filaments small enough to ensure that sand, gravel, slag, etc. would be firmly held in the interstices of the fibrous structure without being washed out.

One example of such an erosion control matting is described for example in German Patent Specification No. 2,321,362. This matting consists of a tangled nonwoven article of helically crimped synthetic macrofibers, bonded at their points of intersection and combined with a fabric or nonwoven backing of fine denier synthetic fibers. The fiber openings or interstices formed between the helically crimped macrofibers will only accommodate and hold gravel, sand or soil to a limited extent. Vibration of the nonwoven sheet is necessary to incorporate the sand, gravel, etc., and this operation is therefore preferably accomplished before laying the nonwoven sheet in position for erosion control.

A similar erosion control matting is described in German Design Pat. No. 7,133,997. However, this patent relates to a relatively open lattice-like fabric which is secured to the nonwoven of crimped macrofibers by means of needle-punching. This known matting presents on the one hand the drawback of an expensive multistage manufacturing process. On the other hand, the filling capacity with sand, soil, gravel, etc. is very limited because of the relatively dense fiber configuration.

The prior art has thus been faced with a dilemna in that a high capacity of the matting to hold soil, sand or the like has been accompanied by very poor soil or sand retention. As the matting is made more dense, it retains soil, sand or the like more easily but it is hard to fill and can lose most of its porosity.

In said earlier copending application, Ser. No. 703,277, the Makansi U.S. Pat. No. 3,266,969 has been cited to disclose a process of extruding filaments to pass vertically through a screen to form a matting with a large number of densely packed tufted loops of very fine denier textile filaments, thereby providing a typical rug or carpet in a uniform side-by-side relationship of the filaments packed into a tufted structure. These tufted structures are not at all useful as soil erosion control mattings since very little soil, sand or the like could be introduced or retained. The use of tightly packed and unbonded fine textile fibers or filaments of this kind is directly opposed to the objects of the present invention.

A primary object of the present innovation is to provide an erosion control matting of improved characteristics, especially a matting exhibiting a highly improved filling capacity while also achieving an improved ability to retain soil, sand, gravel, etc. as well as permitting an improved water drainage. Furthermore, the matting is one of relatively simple construction so as to be easily and inexpensively manufactured. In essence, the present invention retains all of the desirable features of a highly porous, easily installed erosion control matting while at the same time permitting excellent soil-retention within the matting structure. Other objects and advantages of the invention will become more apparent upon consideration of the following specification and claims.

In accordance with the invention, it has now been found that such objects can be achieved in a unique manner with a reinforced erosion control matting having both good porosity and high soil-retention capacity by combining an open-mesh reinforcing lattice of crossbars at the upper facing side with a soil-retaining backing member defining a bottom facing side of the matting arranged approximately parallel to the reinforcing lattice and at a distance therefrom to receive at least several millimeters of soil. Between these two different facing sides of the matting, a plurality of continuous, melt-spun, substantially amorphous, synthetic polymer filaments are laid in a very specific manner to form alveolate cells between the crossbars and extending down to the backing member, i.e. in the form of a honeycombed or multi-chambered structure, with the individual filaments having a diameter of at least about 0.06 mm. and providing both longitudinally and transversely overlapping loops of intermingled filaments bonded at random points of intersection with each other. In particular, the filaments are advantageously arranged in a self-suppporting, three-dimensional, looped structure interlocking with the crossbars and extending downwardly therefrom in multiwalled alveolate cells such that at least part of the filaments are also bonded and firmly adhered to the soil-retaining, fibrous backing member.

In its most preferred embodiment, the matting of the present invention offers a honeycombed or alveolated filamentary structure with a cell depth that is at least as great or preferably greater than the cell width and breadth (measuring two directions) and ordinarily a depth of at least 1 cm. and most usefully of about 2 to 15 cm. The walls of the cell structure, projecting beneath each crossbar, are of relatively high density and contain a substantially larger proportion of the looped filaments while the central portion of each cell contains a very minor proportion of the filaments. Such a high density cell wall structure combined with a low density central cell portion permits one to achieve excellent soil retention in the individual cells with a capacity for a relatively large amount of soil. At the same time, the walls of the individual cells are still much more porous than the backing member so that the matting remains very permeable to water without loss of soil, sand, or the like from the individual cells.

The preferred embodiments of the invention are illustrated in greater detail with the aid of the accompanying drawing in which.

Figure 1:
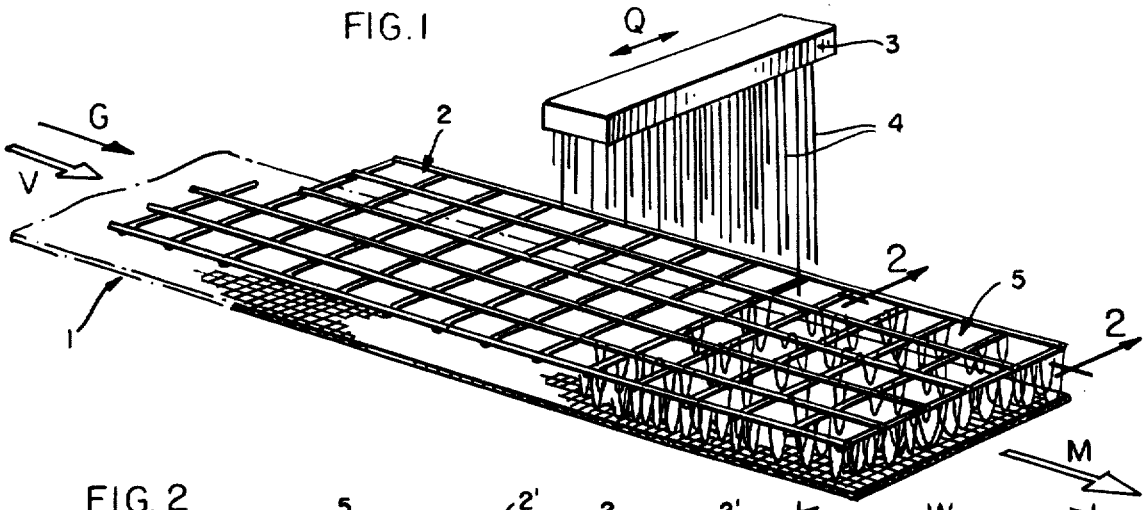
FIG. 1 is a perspective and partly schematic view of the matting of the invention as it is being formed by conducting the lattice member and the backing member under a suitable spinning head or spinneret.
Figure 2:
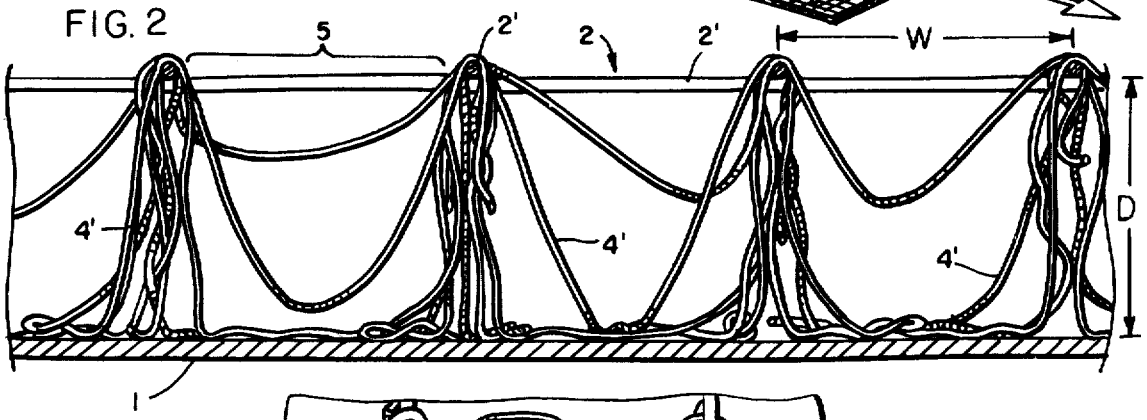
FIG. 2 is a segmented longitudinal section on the line 2—2 shown in FIG. 1 to better illustrate the cell structure as a lateral view through one edge of the matting.
Figure 3:
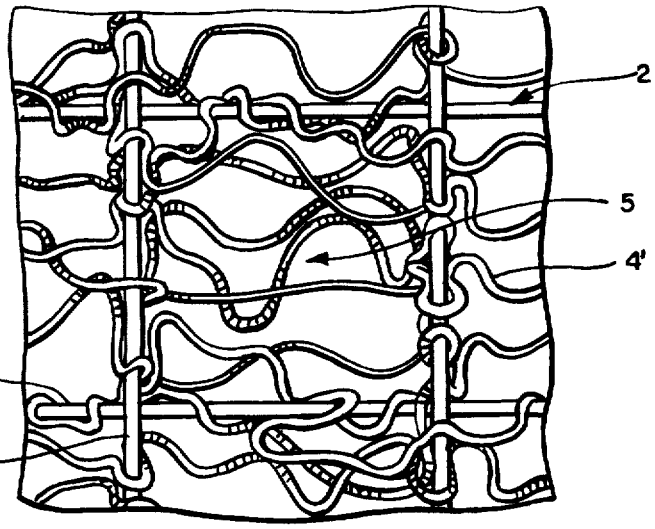
Figure 2A:
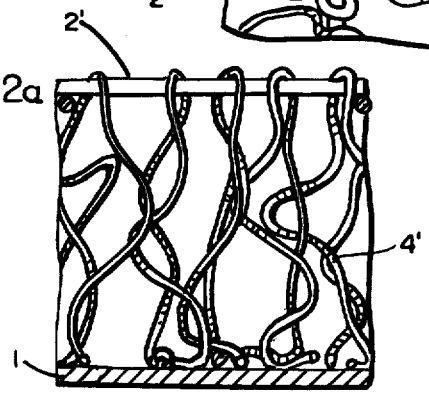
Figure 4:
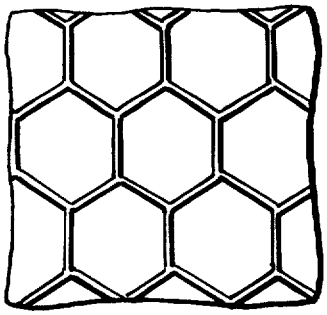

FIG. 2*a* is a fragmented side plan view of a single wall "panel" of an interior cell of the matting;

FIG. 3 is a partial top plan view of the formed matting structure having the same rectangular or square crossbars of the lattice member shown in FIGS. 1 and 2; and FIG. 4 is another partial top plan view of a different embodiment of the matting structure in which the lattice crossbars provide alveolate cells with hexagonal cross sections.

As shown in FIG. 1, a relatively dense fabric backing 1 composed of a nonwoven polyamide tangled fibrous web of a thickness of 0.6 mm. is conducted in the direction of the arrow "V" at a distance of 10 cm. from the spinneret 3 which spins or extrudes the polymer melt into a large number of individual filaments directed downwardly under free fall, first onto the upper lattice or open-meshed reinforcing member 2 which is maintained parallel to the backing 1 at a distance D of about 2.5 cm. while being conducted in the direction of the arrow "G". The lattice 2 is illustrated as a mesh formed of plastic filaments with a diameter of 1 mm. spaced at a distance W of 1.5 cm. from each other (see also FIG. 2).

It is preferable to synchronize the rate of speed of the backing 1 and the lattice 2 and also to regulate their velocity to achieve a controlled deposition of the filaments on the crossbars 2' of the lattice. Because of the closeness of the moving surfaces 1 and 2 to the spinneret 3, the freshly spun filaments remain sufficiently soft and tacky to adhere at least in part to the comparatively dense fabric backing. As the filaments are looped, draped or hung over the individual crossbars, the loops extend downwardly from these crossbars predominately in generally vertical planes approximately perpendicular to the planar surfaces of the lattice 2 and the backing 1.

In FIG. 2, a view is provided through an outer edge wall which is shown practically free of vertically draped or hung filaments in order to better illustrate the almost void central space of each cell, for example less than 30% by weight of the filaments and preferably less than 10% by weight falling into the central space compared to the surrounding filamentary walls and the backing with some accumulation of filaments thereon. In FIG. 2*a*, a view is provided of any inner wall to illustrate the relatively large number of filaments contained therein, thereby forming relatively deep alveolate cells in the central space between adjacently parallel crossbars.

The filaments are spun and draped while still hot and self-bondable. The freshly spun filaments then solidify, and the matting is drawn off in the direction of the arrow "M", being wound up in a coil if sufficiently flexible or otherwise cut into sheets of a specific length and stacked.

The deposition of the filaments 4' between the crossbars 2' are also shown in greater detail in FIG. 3. Again only a very few filaments are deposited in the central open space of each cell 5, most of the filaments looping downwardly in a more nearly vertical direction on either side of each crossbar 2', there being sufficient overlapping or contact of the loops below each crossbar to interlock and hold the grid or lattice 2 in place once the filaments have solidified.

It should be noted in FIGS. 2, 2*a* and 3 that the density of the walls between the alveolate cells 5 can be adjusted by varying the ratio of the spinning speed to the drawoff speed of the matting. Relatively heavy or dense and almost vertical walls can be easily achieved transversely to the direction of travel of the matting since the bulk of the filaments collect in predominately vertically looped form over the transverse crossbars passing under the falling filaments. In order to obtain a satisfactory wall density in the longitudinal direction of the matting, it is generally advisable to move both fabrics in a reciprocating lateral motion below the spinneret and/or to have the spinneret arranged to provide a traversing motion from side to side of the matting, i.e. as indicated by the double-headed arrow "Q".

In this manner, it is possible to achieve relatively dense side walls in a nearly vertical plane extending below each crossbar so that each cell has a horizontal cross section of the same configuration as the crossbars, i.e. a square cross section in FIG. 3 and a hexagonal cross section in FIG. 4. If desired, two or even three spinnerets can be used to provide a more uniform wall density on all sides of each cell. Even the edge walls can be made with the same density as the inner walls (FIG. 2*a*), or by providing small spinnerets with a traversing motion along each of the two edges, these longitudinal walls can be made even denser than the inner walls but preferably still more porous than the bottom or backing sheet 1.

The synthetic polymer filaments used to form the alveolate cells preferably have a diameter of at least 0.1 mm. and especially about 0.4 up to about 1.2 mm. For the manufacture of an extremely heavy erosion control matting (D greater than 15 cm.), it is possible to use filaments having a diameter of 2 mm. and more.

The filaments may be composed of conventional fiber-forming polymers, for example: polyolefins, such as polyethylene or polypropylene; polyesters, such as polyethylene terephthalate or its copolymers; or polyamides, such a polyhexamethylene adipamide. Because of its physical properties, polycaprolactam is especially suitable. Both of the mentioned polyamides offer good qualities of tensile strength combined with resistance to decay or aging. They are particularly useful in heavy duty or high load applications or where the mattings are exposed to harsh weathering conditions.

The comparatively dense fabric backing located at the bottom can be made of natural fibers or yarns obtained therefrom. However, this backing is also preferably composed of synthetic polymer filaments or fibers. In particular, it is most desirable to use a backing of nonwoven fibers or filaments which are laid and entangled or otherwise made into a coherent sheet exhibiting an effective filtering action. Such nonwovens as fabrics, sheets or webs are well known and readily available or easily made. Binders or other adhesives can be used to increase the strength or stiffness of the nonwoven backing although this is relatively unnecessary because the erosion control matting of the invention achieves its strength from the cell-forming filaments and the upper reinforcing lattice. A strong backing is not essential, especially due to the ease of filling soil, sand, gravel or the like into the cells of the matting after it has been laid in place with the backing already supported by the ground or earth therebelow.

On the other hand, some additional adhesive or bonding agent in the backing fabric or web is helpful to hold it together during normal handling during the take off, transport, storage and installation of the erosion control matting. In this respect, the presence of some adhesive or other bonding means is also of value in the attachment or holding of the backing onto the synthetic polymer filaments which form the alveolate cell structure of the matting.

The hot extruded filaments which fall all the way to the backing and may also accumulate in a short looping pattern along the upper surface of the backing do tend to adhere themselves to the backing without additional adhesives or bonding agents. However, a very good cohesion between the synthetic filaments laid over the crossbars of the lattice and the comparatively dense backing can be achieved when the filaments or fibers of the latter have a melting or softening point much lower than that of the synthetic filaments forming the alveolate cells, so that a direct fusion is achieved between the filaments or fibers of the comparatively dense backing and the synthetic filaments forming the alveolate cells. Whether using a woven knitted or nonwoven backing, one can select many known synthetic polymers which provide fibers with a relatively lower melting or softening point, especially copolymers which are well known as so-called "bonding fibers". The backing may contain this type of bonding fiber or low melting point filament as a portion of the total weight of the backing, using only enough to ensure the desired cohesion.

The term "comparatively dense fabric" herein refers to fabrics which exhibit a certain porosity and especially water-permeability, but nevertheless will protect the subsoil against the impact of water running over it and will essentially provide a filtering effect, i.e. so as to prevent the passage of soil or sand particles. In general, an erosion control matting should include a dense fabric backing which will retain very small particles of soil, sand, grit or the like, so that mesh sizes of at least about 40 or higher, i.e. 40 meshes per inch, are useful in most applications. A 10 to 40 mesh fabric or screen is sufficient to retain all visually identifiable solids and can be used to retain coarser sand or soil particles. It is preferred, however, to provide a good filtering effect with a mesh size of about 40 to 400, especially about 60 to 300. It is therefore appropriate to refer to the backing as a "fine mesh fabric", it being understood that felts or nonwovens with an equivalent filtering action may also be used.

Suitable fabrics for the dense backing include relatively tightly woven fabrics, closely knitted fabrics, tangled fibrous nonwovens, felts or bonded textile fabrics, to the extent that the described criteria are met. Use can also be made of non-textile structures, for example fine mesh wire screens. For the protection of steep embankments, an erosion control matting is preferably used in which the comparatively dense fabric is in turn backed with an anchoring layer, for example with an elastic matting as described in German Patent Specification No. 1,810,921.

The term "open-mesh lattice" as employed herein refers to any fabric, web or screen provided with evenly distributed openings, whose dimensions will accommodate beads, spheres or particles of a diameter of about 5 mm. or more. These openings may be circular, oval, rectangular (especially square), rhombic, hexagonal, etc. Suitable open-mesh lattice members have a preferably planar structure, i.e., such as a sheet, fabric or screen especially screen wire (wire netting), wire matting, plastic netting (monofilament structures), wide mesh knits, loosely woven fabrics or yarn structures, braided sheet metal, sheets of plastic, etc. The cross members between adjacent openings, regardless of their shape or position are referred to as "crossbars". The lattice reinforcing member, depending upon its construction and/or material, may be either relatively stiff or flexible. The material selected should preferably be strong enough to contribute decisively to the strength of the erosion control matting. For certain applications, e.g. in a horizontal placement of the erosion control matting, lattice members of low tenacity are sufficient because their function is merely that of a form for the deposition of filaments to make the alveolate cells.

The open-mesh lattice may thus be idenfified as a "coarse mesh" fabric, netting, screen or the like with a minimum sieve opening of about 5 mm., preferably at least about 1 cm. up to about 5 cm. or even higher when using spun filaments with diameters larger than 2 mm. The most important distinction is that to be made between the "fine mesh" backing with a sieve opening or its equivalent of no larger than about 2 mm. and the "coarse mesh" lattice with a sieve opening of at least about 5 mm.

The walls or panels of the alveolate cells should preferably be constructed to provide an average "density" or "sieve opening" or the equivalent thereof which is intermediate of the lattice member and the backing member. Depending upon the number of filaments, the extent of overlapping and filament diameter, the openings or interstices in the cell walls will always be substantially smaller than the corresponding lattice openings and most advantageously will always be substantially larger than the corresponding fine mesh openings of the backing member. This desirable construction ensures a good porosity and higher water-flow capacity through the walls of the alveolate cells as compared to the fine mesh backing, so that undercutting or displacement of the matting is substantially prevented.

The openings or interstices of the cell walls correspond to a wide range of sizes intermediate the outer parameters of the mesh sizes offered by the lattice and backing members. A soil analysis of the area to be protected against water or wind erosion can be carried out in a routine manner to dictate the most useful densities or porosities to be achieved in each component of the matting, i.e., in the lattice, the backing and the individual cell walls.

In general, based upon the preferred filament dimensions and mesh sizes noted above, the cell walls preferably have an equivalent mesh size on the order of about 3 up to 200, and especially about 10 to 60. These mesh sizes correspond to average opening or interstices in the filamentary wall on the order of between about 0.250 inches (6.35 mm.) and 0.003 inches (0.074 mm.), and especially between about 0.08 inches (2 mm.) and 0.01 inches (0.25 mm.). Once this dimension is chosen for the cell walls in order to provide a satisfactory soil retention (including sand, gravel or other kinds of soil), then one can select a backing with a fine mesh opening on the order of at least one-half and preferably at least one-tenth the size of the openings in the cell walls. Likewise, a much larger opening or mesh size is selected for the reinforcing lattice, especially one which will permit an easy filling of the largest soil particles to be used.

The filaments forming the alveolate cells are preferably "self-bonded", i.e., without adding special adhesives. Referring again to FIG. 1, such self-bonding can be achieved by working with the spinneret 3 close enough to the lattice member 2 and backing 1 to ensure that the filaments will fuse or weld together as they are being laid and draped over the crossbars 2'. Self-bonding can also be achieved by a simultaneous or subsequent heat treatment of the filaments 4 and/or the filaments or fibers in the backing 1. Alternatively, the special bonding fibers mentioned above or other adhesives or bonding agents may be applied, e.g., by spraying, brushing or otherwise applying these bonding agents onto or within the initially formed matting structure. It is a particular advantage of the invention that these additional bonding agents are not essential but are merely used as an auxiliary binding means if at all. Accordingly, the fact that filaments or fibers are mutually "bonded", as described herein, is not intended to exclude the use of a separate adhesive or binder.

The "alveolate cells" formed as indicated in FIGS. 2-4, inclusive, are well-defined multi-walled compartments in the nature of a honeycomb structure which has a distinct cross sectional shape at the upper facing side and substantially this same cross sectional shape over the depth of the cell which may then be filled with sand, gravel, slag, rocks or the like. These cross sections parallel to the upper facing side of the matting may be circular, oval, triangular or preferably rectangular (especially square). An essentially hexagonal cross section is otherwise also preferred. The cell structure required by the present invention differs from a natural honeycomb in that the walls of each cell are relatively open and porous due to their formation by overlapping and intersecting filaments.

In general, the depth D of the alveolate cells 5 of the invention is represented by the distance between the backing member 1 and the reinforcing lattice 2, as the dimension most appropriate for filling with soil, sand, gravel, etc. A minimum depth of a few millimeters, e.g, about 3 to 10 mm. is sufficient where one is providing a lightweight embankment or a horizontal ground cover, e.g. for laying sod, turf or the like. For most applications, the depth D is preferably selected as being at least about 1 cm. and particularly between about 2 and 15 cm. However, it is also possible to use filling depths of more than 15 cm. if the melt-spun filaments are selected with a correspondingly larger diameter.

The greatest width W of the alveolate cells may be a fraction or a multiple of the depth D, depending upon the specific application of erosion control. Again, the dimensions are less critical for lightweight and/or horizontally positioned mattings. If the matting is to be installed in an oblique or even vertical position, the greatest width W is preferably no greater than the depth D. The preferred ratio of D/W in this case is between about 2 and 5.

The erosion control matting is preferably carried out by the so-called "dry process" of melt-spinning the filaments directly onto the lattice member and the parallel backing thereunder as these are transported on drums or by nip rolls, edge belts or the like, and with or without an application of hot air to ensure self-bonding. At sufficiently high transporting speeds, it is feasible to form the matting as described in the copending application, Ser. No. 703,277, whereby relatively shallow reentrant cells are formed of more random cross section, and the self-supporting spun and solidified filaments may even be removed from the lattice where there is little or no bonding or locking of these filaments beneath the lattice cross bars. However, for purposes of the present invention it is advisable to retain the reinforcing lattice and to have it interlocked with and supported by the melt-spun, cell-forming filaments.

In another variation of the process of producing a matting according to said copending application, Ser. No. 703,277, and further modified herein, the matting can be at least partly formed by the so-called "wet process" in which the melt-spun filaments are directed vertically downwardly into a cooling bath to form regular loops with a helical to sinuous configuration in a plurality of contacting or slightly overlapping rows of such regular loops. This "wet process" is fully disclosed in U.S. Pat. Nos. 3,687,759; 3,691,004 and 3,852,152, and can be carried out to provide a matting of uniform or variable density with superimposed rows of helical to sinuous filamentary loops which, when overlapped and mutually bonded, offer a very high compressive strength in the longitudinal direction and also good lateral tenacity.

For purposes of the present invention, this melt-spun matting by the wet process is preferably made as described in U.S. Pat. No. 3,691,004 with loops made parallel along the bottom side of the matting by means of a guide plate extending at an angle into the cooling bath. Such a matting can be used as the backing or as part of a composite backing for the erosion control matting of the present invention, e.g., as an underlayer below a fine mesh fabric backing.

The wet process may also be used to partly fill the alveolate cells with regularly looped filaments, although the center of each cell must remain sufficiently open to permit a simple filling with soil, sand, gravel, etc. However, in order to provide exceptionally strong and durable erosion control mattings, e.g. with alveolate cells made with very large diameter filaments (more than 1.2 mm.) and formed with a great depth (more than 15 cm.), the initial matting with the alveolate cells completely formed can be conducted through the cooling bath of the wet process, with or without the inclined plate, so as to receive a further partial filling out or backing addition of the regularly looped melt-spun and bath laid filaments.

These and other variations in the available melt-spinning processes can be readily adopted to provide modified matting structures combined with or incorporated within the essential lattice reinforced and fabric backed alveolate cells essential to the present invention. In all cases, however, the relative density or degree of porosity or openness of the lattice, backing and alveolate cell structure must be observed.

In addition to being used for the protection of embankments, dikes, beaches, shorelines, streams, canal beds and the like, the erosion control matting according to the innovation can also be used as a drainage element. For the vertical drainage of building foundations or basement walls, the matting is installed so that the comparatively dense fabric backing faces outwardly against the surrounding soil. For horizontal drainage, the matting is laid out so that the dense fabric backing faces upwardly. When used as a drainage matting, it is filled with gravel, slag, rocks or similar aggregate or coarse sand materials, preferably with the addition of a binder to prevent compacting by the soil.

The erosion control mattings may also be used in the construction of playing fields as a rapidly draining layer beneath a natural or artificial turf. Lighter weight embodiments of these mattings can further be used as a temporary retaining means on gentle embankments or in landscaping applications to begin new grass areas or to maintain young plants in place until they are more mature. These and other advantageous applications will be readily suggested to those skilled in the matting and erosion control arts.

The invention is hereby claimed as follows:

1. A porous, reinforced, erosion control matting which comprises:

an open-mesh reinforcing lattice or crossbars defining an upper facing side of the matting;

a plurality of continuous, melt-spun, substantially amorphous, synthetic polymer filaments having a diameter of at least about 0.06 mm., said filaments being laid onto and interlocked with substantially all of the crossbars of said lattice in the form of longitudinally and transversely overlapping loops of intermingled filaments bonded at random points of intersection and extending downwardly from said lattice to form porous multi-walled alveolate cells between the crossbars in a self-supporting, three-dimensional, looped structure; and a soil-retaining, fibrous backing member defining a bottom facing side of the matting arranged approximately parallel to said lattice and at a distance therefrom sufficient to receive at least several millimeters of soil, at least part of the filaments being bonded to said backing member.

2. An erosion control matting as claimed in claim 1 wherein the alveolate cells have a rectangular cross section taken in the plane of or parallel to said lattice.

3. An erosion control matting as claimed in claim 1 wherein the alveolate cells have a hexaganol cross section taken in the plane of or parallel to said lattice.

4. An erosion control matting as claimed in claim 1 wherein the diameter of the synthetic polymer filaments is about 0.4 to 1.2 mm.

5. An erosion control matting as claimed in claim 1 wherein the synthetic polymer of the filaments is selected from the group consisting of polyolefins, polyesters and polyamides.

6. An erosion control matting as claimed in claim 1 wherein the synthetic polymer of the filaments is polycaprolactam.

7. An erosion control matting as claimed in claim 1 wherein the backing member is composed of synthetic polymer fibers or filaments.

8. An erosion control matting as claimed in claim 1 wherein the alveolate cells have a depth D which is greater than about 1 cm.

9. An erosion control matting as claimed in claim 8 wherein the greatest width W of the alveolate cells does not exceed the depth D of said cells.

10. An erosion control matting as claimed in claim 9 wherein the ratio of depth to width D/W of the alveolate cells is between about 2 and 5.

11. An erosion control matting as claimed in claim 1 wherein the alveolate cells have a depth D of about 2 to 15 cm.

12. An erosion control matting as claimed in claim 11 wherein the greatest width W of the alveolate cells does not exceed the depth D of said cells.

13. An erosion control matting as claimed in claim 12 wherein the ratio of depth to width D/W of the alveolate cells is between about 2 and 5.

14. An erosion control matting as claimed in claim 1 wherein the greatest width W of the alveolate cells does not exceed the depth D of said cells.

15. An erosion control matting as claimed in claim 14 wherein the ratio of depth to width D/W of the alveolate cells is between about 2 and 5.

16. An erosion control matting as claimed in claim 1 wherein the backing member is a water-permeable, soil-retaining, rot-resistant, comparatively dense woven, non-woven or knitted fabric.

17. An erosion control matting as claimed in claim 16 wherein the fabric backing member contains filaments or fibers of a substantially lower softening point than the synthetic filaments forming the alveolate cells.

18. An erosion control matting as claimed in claim 16 wherein the backing member is a non-woven fabric of tangled fibers or filaments.

19. An erosion control matting as claimed in claim 18 wherein the fibers or filaments of the non-woven backing member are made of a synthetic polymer selected from the group consisting of polyethylene terephthalate, polyhexamethylene adipamide and polycaprolactam.

20. An erosion control matting as claimed in claim 18 wherein the backing member contains fibers or filaments of a substantially lower softening point than the synthetic filaments forming the alveolate cells.

21. An erosion control matting as claimed in claim 1 wherein said open-mesh lattice provides a mesh opening of at least about 5 mm., said fibrous backing member has a mesh size of at least about 10 meshes per inch, and the walls of said alveolate cells have a mesh size on the order of about 3 up to 200 meshes per inch.

22. An erosion control matting as claimed in claim 21 wherein the mesh opening of said lattice is about 1 to 5 cm., the mesh size of the backing member is about 40 to 400 meshes per inch, and the mesh size of the alveolate cell walls is about 10 to 60 meshes per inch.

23. An erosion control matting as claimed in claim 21 wherein the mesh size of the backing member is about 60 to 300 meshes per inch, and the mesh size of the alveolate cell walls is about 10 to 60 meshes per inch.

24. An erosion control matting as claimed in claim 23 wherein the mesh opening of said lattice is about 1 to 5 cm.

* * * * *